US007895998B2

(12) United States Patent
Lee

(10) Patent No.: US 7,895,998 B2
(45) Date of Patent: Mar. 1, 2011

(54) DOOR LOCK DEVICE

(75) Inventor: June-Young Lee, Gimhae (KR)

(73) Assignee: Poong Won Industry Co., Ltd. (KR)

( * ) Notice: Subject to any disclaimer, the term of this patent is extended or adjusted under 35 U.S.C. 154(b) by 0 days.

(21) Appl. No.: 12/165,956

(22) Filed: Jul. 1, 2008

(65) Prior Publication Data

US 2009/0260409 A1 Oct. 22, 2009

(51) Int. Cl.
*F23M 7/00* (2006.01)

(52) U.S. Cl. ..... 126/197; 126/194; 292/266; 292/271; 292/273; 292/327; 70/81; 70/277; 70/278.7; 70/308; 70/318

(58) Field of Classification Search ..... 292/266, 292/271, 273, 327; 70/308, 318, 81, 277, 70/278.7; 126/194, 197
See application file for complete search history.

(56) References Cited

U.S. PATENT DOCUMENTS

| | | | | | |
|---|---|---|---|---|---|
| 2,198,079 | A | * | 4/1940 | Ferris et al. | 292/143 |
| 2,378,421 | A | * | 6/1945 | McCormick | 126/190 |
| 2,910,317 | A | * | 10/1959 | Conlee | 292/64 |
| 3,072,117 | A | * | 1/1963 | Stoligrosz et al. | 126/191 |
| 3,113,566 | A | * | 12/1963 | Milburn et al. | 126/194 |
| 3,313,918 | A | * | 4/1967 | Barber | 219/412 |
| 3,436,860 | A | * | 4/1969 | James | 49/192 |
| 3,602,662 | A | * | 8/1971 | Haller | 200/61.62 |
| 3,712,287 | A | * | 1/1973 | Summers, Jr. | 126/191 |
| 3,731,963 | A | * | 5/1973 | Pond | 292/144 |
| 3,749,080 | A | * | 7/1973 | Kleinhenn | 126/191 |
| 3,838,538 | A | * | 10/1974 | Burford | 49/258 |
| 3,857,002 | A | * | 12/1974 | Lay et al. | 200/61.64 |
| 4,021,968 | A | * | 5/1977 | Kendall | 49/386 |
| 4,088,354 | A | * | 5/1978 | Kolendowicz | 292/201 |
| 4,106,609 | A | * | 8/1978 | Kaspar | 194/247 |
| 4,138,988 | A | * | 2/1979 | Hurley | 126/194 |
| 4,161,870 | A | * | 7/1979 | Barnes | 70/278.7 |
| 4,163,344 | A | * | 8/1979 | Scherer | 49/386 |
| 4,194,321 | A | * | 3/1980 | Hess | 49/389 |
| 4,269,165 | A | * | 5/1981 | Wrotny et al. | 126/191 |
| 4,351,288 | A | * | 9/1982 | Gasloli | 126/197 |
| 4,477,130 | A | * | 10/1984 | Frantz | 312/219 |
| 4,623,179 | A | * | 11/1986 | Davis et al. | 292/201 |
| 4,665,892 | A | * | 5/1987 | Spargo et al. | 126/194 |
| 4,817,240 | A | * | 4/1989 | Sovis et al. | 16/297 |
| 5,025,776 | A | * | 6/1991 | Hanley et al. | 126/194 |
| 5,341,542 | A | * | 8/1994 | Hannan et al. | 16/289 |
| 5,397,948 | A | * | 3/1995 | Zoerner et al. | 310/46 |

(Continued)

FOREIGN PATENT DOCUMENTS

DE 202004001337 U1 * 5/2004

(Continued)

*Primary Examiner* — Kenneth B Rinehart
*Assistant Examiner* — Jorge Pereiro
(74) *Attorney, Agent, or Firm* — Park & Associates IP Law LLC

(57) ABSTRACT

A door lock device includes a fixing rack, an operation rack, a solenoid device, an engaging member, and a locking pin. The fixing rack is installed in a receptacle and has a hinge shaft. The operation rack is coupled with the hinge shaft. The solenoid device is installed in the receptacle and has a rod. The engaging member is assembled to the rod and ascends or descends in response to the operation of the solenoid device. The locking pin is installed in the operation rack and performs a locking or unlocking function to the door.

7 Claims, 5 Drawing Sheets

U.S. PATENT DOCUMENTS 5,822,925 A * 10/1998 McKinney et al. ..... 49/386
5,881,710 A * 3/1999 Davis et al. ..... 126/194
5,937,481 A * 8/1999 Faringosi ..... 16/332
6,035,848 A * 3/2000 Ray et al. ..... 126/194
6,397,836 B1 * 6/2002 Pelletier et al. ..... 126/194
6,438,799 B1 * 8/2002 Gronbach ..... 16/335
6,453,510 B1 * 9/2002 Cummins et al. ..... 16/343
6,539,581 B1 * 4/2003 Faringosi ..... 16/327
6,637,319 B1 * 10/2003 Vanini et al. ..... 99/467
6,789,293 B2 * 9/2004 Habegger et al. ..... 16/343
6,892,424 B1 * 5/2005 Habegger et al. ..... 16/289
6,968,597 B2 * 11/2005 Habegger et al. ..... 16/297
6,986,187 B2 * 1/2006 Cummins et al. ..... 16/286
7,017,232 B1 * 3/2006 Priddy ..... 16/286
7,134,169 B2 * 11/2006 Habegger et al. ..... 16/297
7,150,071 B2 * 12/2006 Collene et al. ..... 16/289
7,243,396 B2 * 7/2007 Vanini ..... 16/286
7,275,283 B2 * 10/2007 Kistner et al. ..... 16/286
7,467,834 B2 * 12/2008 Kim et al. ..... 312/402
7,498,513 B2 * 3/2009 Tollefson ..... 174/50
2003/0213098 A1 * 11/2003 Cummins et al. ..... 16/286
2005/0127804 A1 * 6/2005 Kim et al. ..... 312/402
2005/0155181 A1 * 7/2005 Habegger et al. ..... 16/297
2006/0032019 A1 * 2/2006 Kistner et al. ..... 16/286
2006/0118253 A1 * 6/2006 Slusarski et al. ..... 160/271
2007/0101542 A1 * 5/2007 Lee ..... 16/286
2007/0144562 A1 * 6/2007 Classen et al. ..... 134/57 DL
2007/0193572 A1 * 8/2007 Lee ..... 126/194
2007/0267401 A1 * 11/2007 Collene et al. ..... 219/391

FOREIGN PATENT DOCUMENTS

JP 2001014530 A * 1/2001
KR 2004001175 A * 1/2004

* cited by examiner

DOOR LOCK DEVICE

FIELD OF THE INVENTION

The present invention relates to a door lock device. More particularly, the present invention relates to a door lock device in which, for the purpose of protecting a user from a heat generated at the time of execution of a self-cleaning function of an oven, a solenoid device is installed in a receptacle to forcibly lock the door, thereby preventing the user from artificially opening the door.

BACKGROUND OF THE INVENTION

As well known in the art, a cooking oven is a cooking instrument for receiving and cooking food by a radiant heat and a convection heat within a cavity of the oven.

As the oven is diversified in its function, even kind of cookable food increases, so its use increases. Therefore, an opportunity of contaminating the internal of the cavity owing to food dregs, etc. increases that much. In order to clean the stained cavity, the oven generally has a self-cleaning function.

The self-cleaning function refers to a function of cleanly cleaning the cavity internal by keeping the cavity internal of the cooking oven at about 450° C. for a predetermined time (about 15 minutes to the minimum), thermally analyzing food contaminants accumulated in the internal, and then exhausting out gas and smoke generated from the thermal analysis. The self-cleaning function requires processes of increasing a temperature of the cavity internal to a high temperature of about 400° C., maintaining the high-temperature cavity internal for about 15 minutes, and then again cooling the cavity internal. In general, it takes two hours or more to complete all the processes.

During the operation processes, the cavity is kept at a high temperature. Thus, a careless infant or user may get burned because of a heat emitted out when a door is opened. In order to prevent this accident, the oven door is now equipped with a safety device. However, because the safety device is generally installed at the outside of the door, the user may undesirably open the door by force, thus reducing by half a function of a lock device and also having poor appearance.

SUMMARY OF THE INVENTION

An aspect of exemplary embodiments of the present invention is to address at least the problems and/or disadvantages and to provide at least the advantages described below. Accordingly, an aspect of exemplary embodiments of the present invention is to provide a door lock device for forcibly keeping a door in a lock state at the time of execution of a self-cleaning function of an oven.

According to one aspect of exemplary embodiments of the present invention, provided is a door lock device. The device includes a fixing rack, an operation rack, a solenoid device, an engaged fragment, and a locking pin. The fixing rack is installed in a receptacle of an oven and has a hinge shaft. The operation rack is coupled with the hinge shaft of the fixing rack to open/close a door. The solenoid device is installed in the receptacle and has a rod. The engaged fragment is assembled to the rod of the solenoid device and ascends or descends depending on an operation of the solenoid device. The locking pin is installed in the operation rack and performs a locking or unlocking function depending on an operation of the engaged fragment.

BRIEF DESCRIPTION OF THE DRAWINGS

The above and other objects, features and advantages of the present invention will become more apparent from the following detailed description when taken in conjunction with the accompanying drawings in which.

Throughout the drawings, the same drawing reference numerals will be understood to refer to the same elements, features and structures.

DETAILED DESCRIPTION OF THE INVENTION

Exemplary embodiments of the present invention will now be described in detail with reference to the annexed drawings. In the following description, a detailed description of known functions and configurations incorporated herein has been omitted for conciseness.

Figure 1:
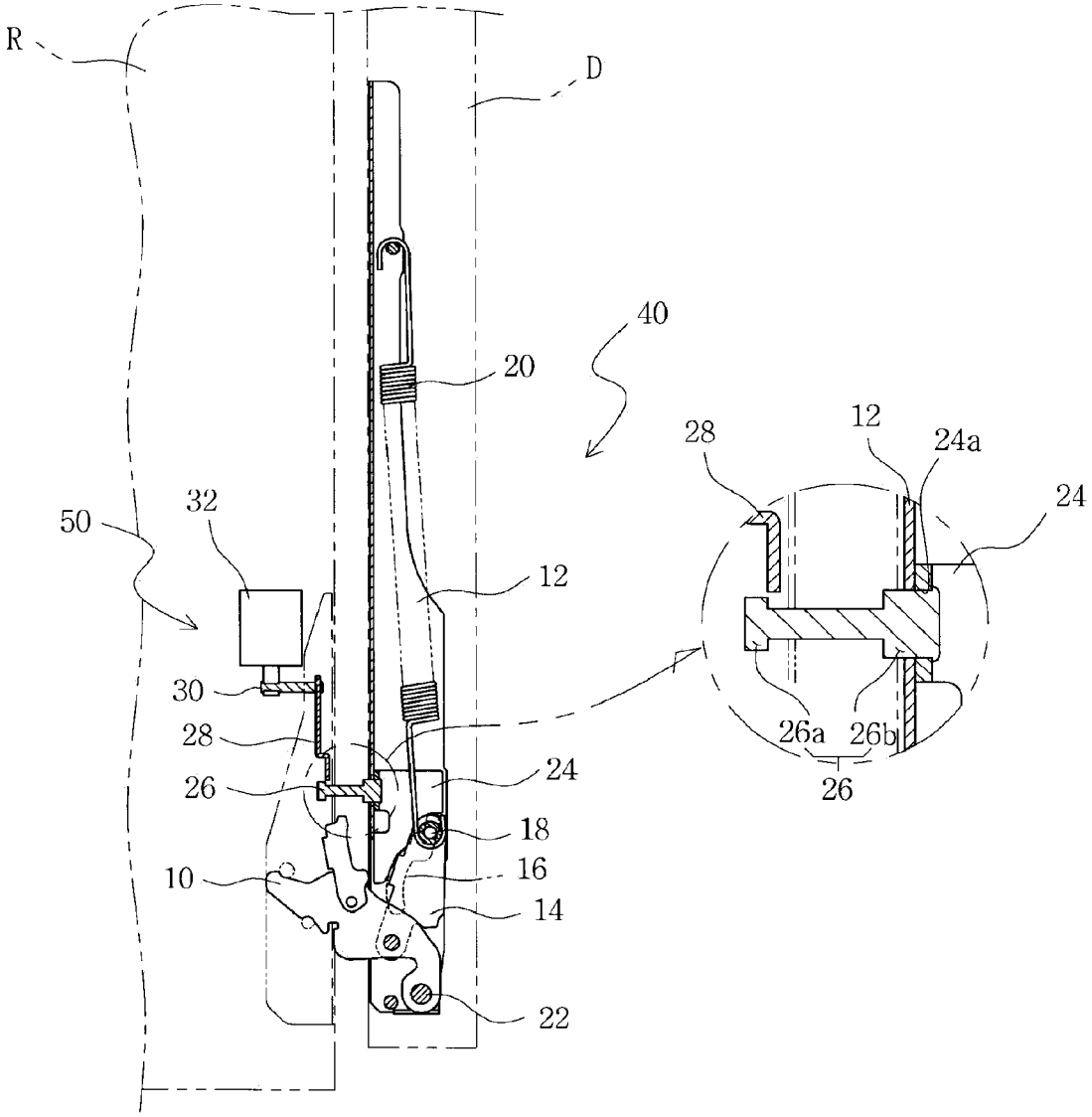
FIG. 1 is a side cross-section illustrating an assembly structure of a door lock device according to an exemplary embodiment of the present invention.
Figure 2:
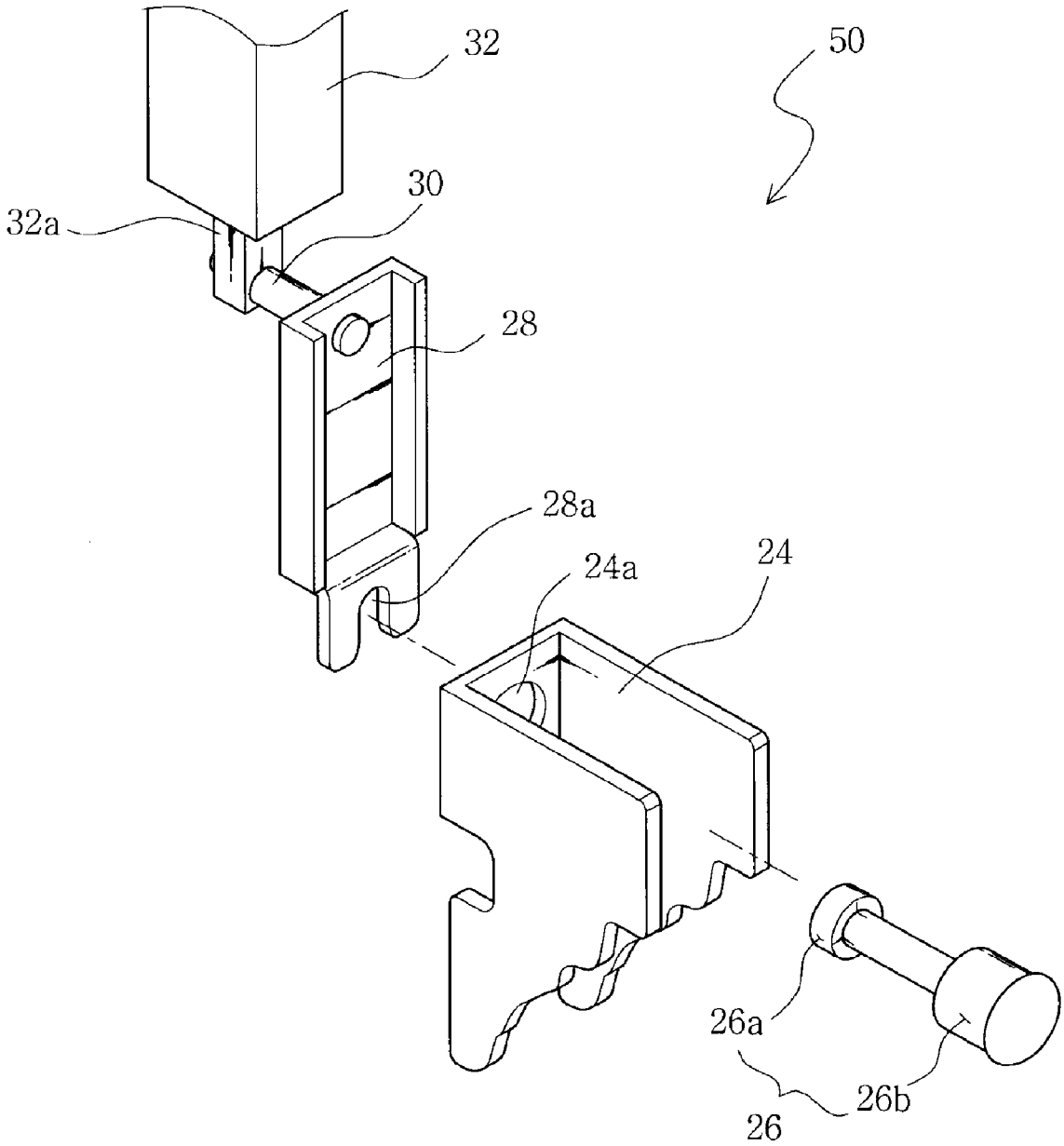
FIG. 2 is an exploded perspective diagram illustrating concrete constituent elements of a locking means of the door lock device of FIG. 1.
Figure 3:
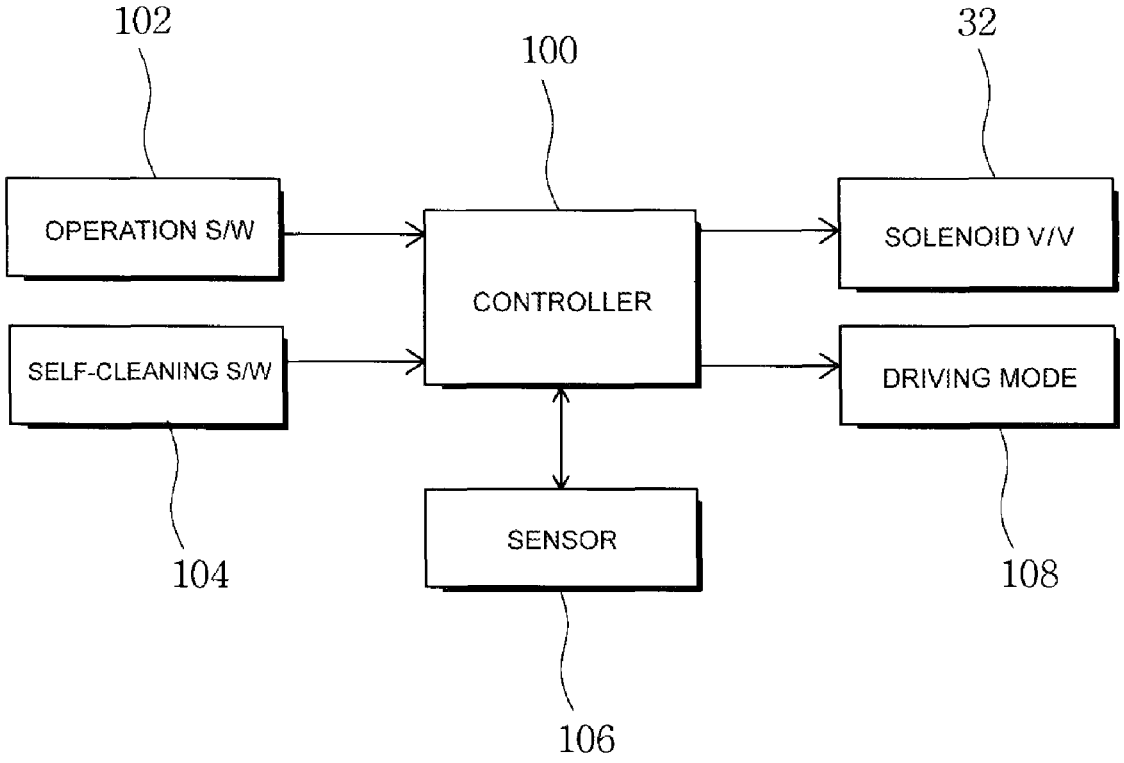
FIG. 3 is a block diagram illustrating a construction of a door lock device according to an exemplary embodiment of the present invention.

FIGS. 1 to 3 are diagrams illustrating a construction of a door lock device according to an exemplary embodiment of the present invention. The door lock device includes a door hinge 40 and a locking means 50. The door hinge 40 includes a fixing rack 10. The fixing rack 10 is installed in a receptacle (R) and supports constituent parts of the door hinge 40. The door hinge 40 includes an operation rack 12, a rotary plate 14, and a connection member 24. The operation rack 12 is coupled with the fixing rack 10 by a hinge shaft 22 and rotates centering on the hinge shaft 22 at a time a door (D) is opened and closed.

The operation rack 12 has a U-shaped cross section. The rotary plate 14 and the connection member 24 are installed within the operation rack 12. The connection member 24 has a U-shaped cross section (see FIG. 2) and is received within the operation rack 12 and has a fitting hole 24*a* into which a locking pin 26 described later is fitted. The operation rack 12 has guide holes 16 at its both lateral sides such that a guide pin 18 described later can move up/down as the door (D) rotates. The guide pin 18 is fitted into the guide holes 16. The guide pin 18 is coupled with the rotary plate 14 and moves slidably in the guide holes 16. The guide pin 18 is coupled with a spring 20 installed in the operation rack 12. One end of the spring 20 is fixed to the upper portion of the operation rack 12, and the other end to the guide pin 18. When the door (D) is opened, the spring 20 moves along the guide pin 18, enabling smooth opening of the door (D) by a tension force.

The fixing rack 10 is installed in the receptacle (R). A solenoid device 32 is installed at an upper side of the fixing rack 10. The solenoid device 32 forcibly locks the door (D) during the execution of a self-cleaning function of an oven and unlocks the locked door (D) after completion of the self-cleaning function. These are performed through an engaging member 28 and the locking pin 26. The self-cleaning function is controlled by a controller 100 in response to switching of a self-cleaning switch 104 shown in FIG. 3. In addition, an operation switch 102 is a switch for operating the oven. In response to switching of the operation switch 102, the controller 100 enables a driving mode 108 for executing an oven function. A temperature sensor 106 senses an internal temperature of the oven and transmits the sensed temperature to the controller 100.

A link 30 is fitted to a rod 32*a* of the solenoid device 32 at its one end and is fitted to the engaging member 28 at the other end. The engaging member 28 is formed in a rectangular shape. The engaging member 28 is bent at its lower end part and has a fitting part 28*a* having a long-hole or groove shape by cutaway along the a center. Having the open-end groove shape, the fitting part 28*a* can effectively catch the locking pin 26 which has a cylindrical shape.

The locking pin 26 is fitted into the fitting part 28*a*. The locking pin 26 is fitted into or released from the fitting part 28*a* in response to an operation of the solenoid device 32. That is, the locking pin 26 has a cylindrical shape with a cylindrical fitting protrusion 26*a* protruded and formed at its distal end. The fitting protrusion 26*a* is caught against a rear surface of the U-shaped groove portion of the fitting part 28*a* and prevents user's inadvertent opening of the door when a user undesirably intends to open the locked door (D).

A cylindrical protrusion 26*b* is protruded and formed in the other end of the locking pin 26 and is fitted into the fitting hole 24*a* of the connection member 24. The locking pin 26 is assembled such that the locking pin 26 is fitted into the fitting hole 24*a* of the connection member 24 and is not released from the fitting hole 24*a* by the cylindrical protrusion 26*b*. In an alternate method, the connection member 24 can perform the same function by providing a separate hole in the operation rack 12 and fitting the locking pin 26 into the hole of the operation rack 12.

Figure 4:
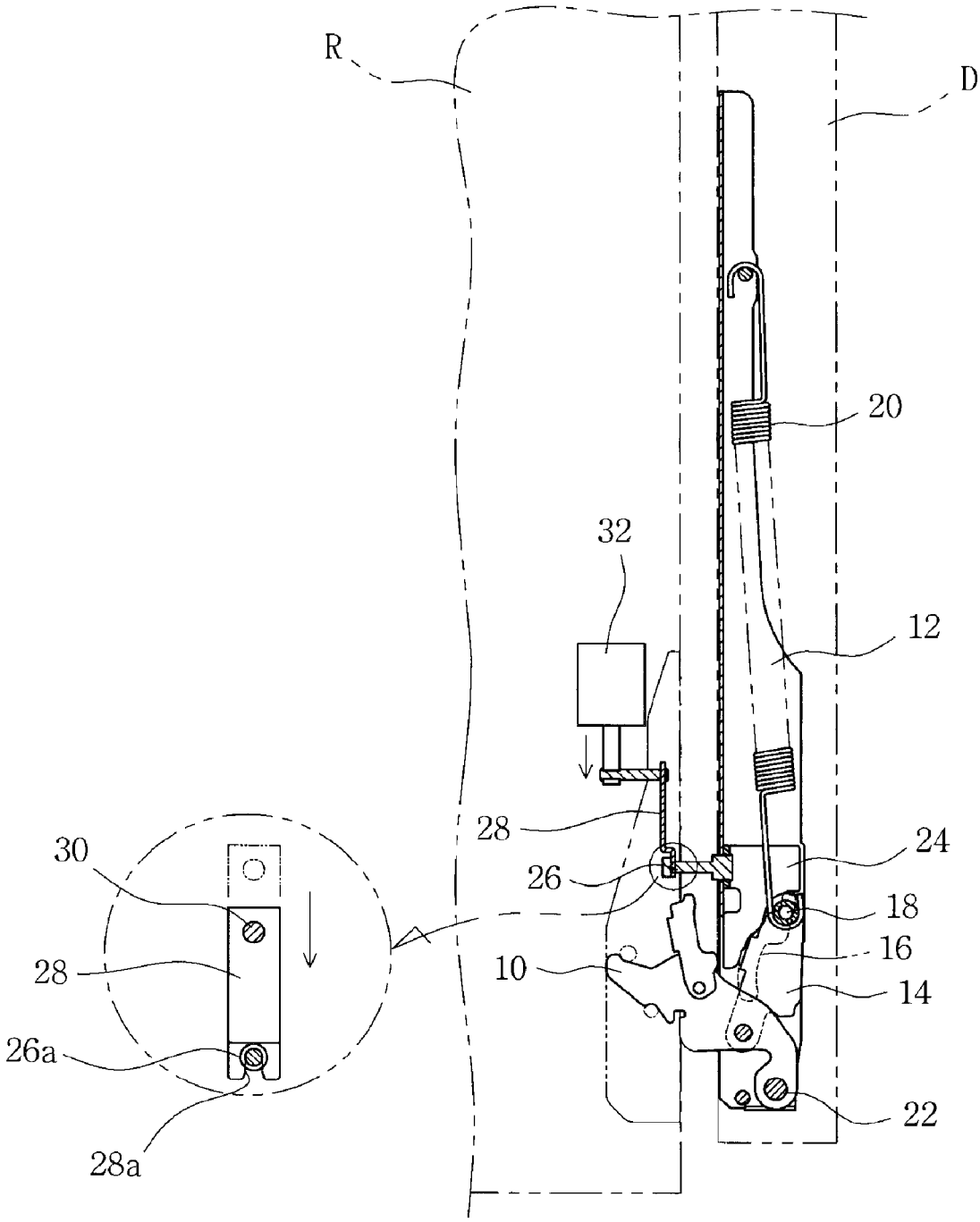
FIG. 4 is a cross section illustrating a state of enabling a locking function of a door lock device according to an exemplary embodiment of the present invention.
Figure 5:
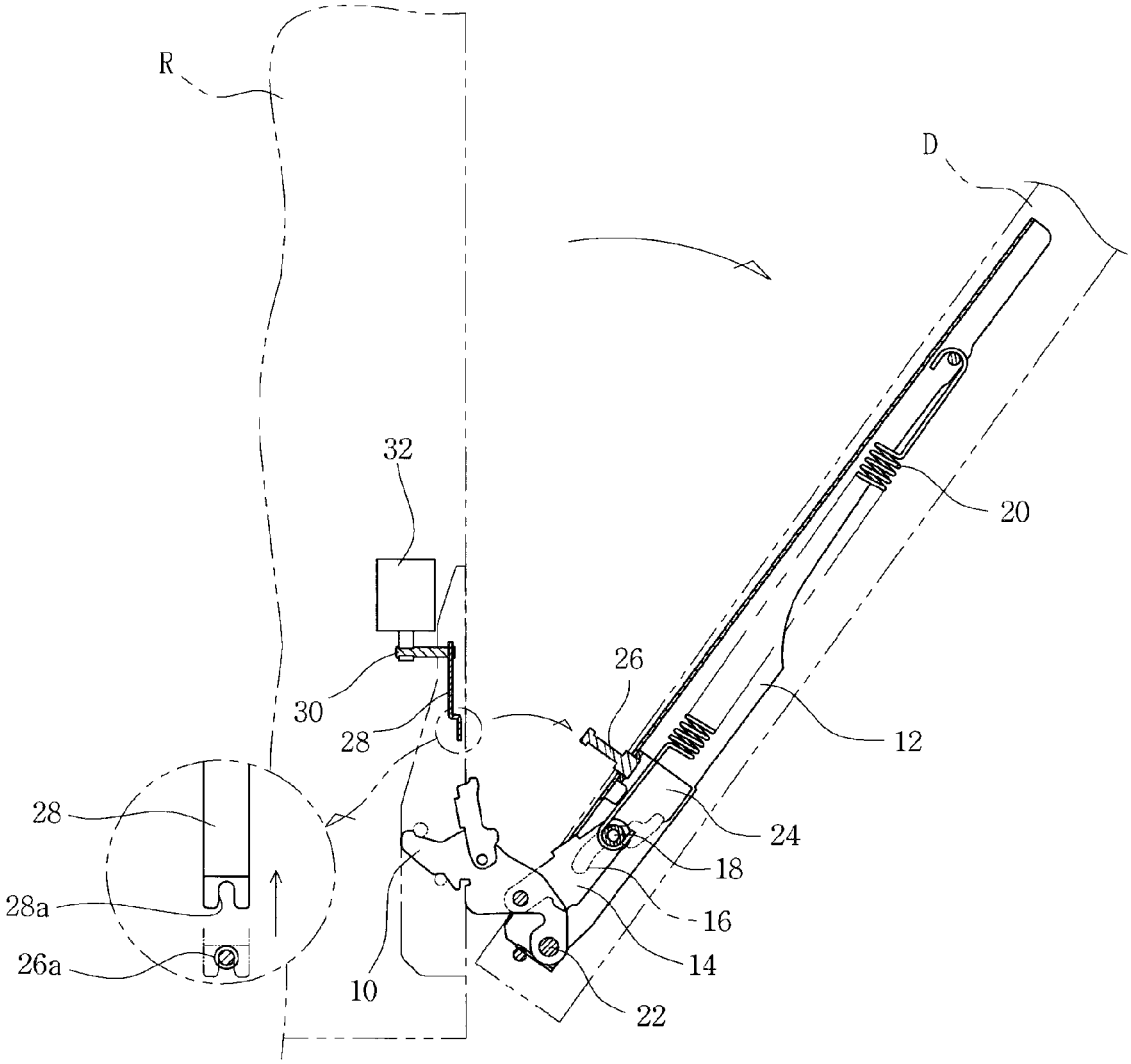
FIG. 5 is a cross section illustrating a state of disabling a locking function of a door lock device according to an exemplary embodiment of the present invention.

Operation of the above-constructed door lock device according to an exemplary embodiment of the present invention is described below with reference to accompanying FIGS. 3 to 5. A rotation operation of the door hinge 40 included in the door lock device according to an exemplary embodiment of the present invention is a well-known technology and thus, its detailed description is omitted below.

In response to switching of an operation switch 102, a controller 100 enables a driving mode 108 and performs an oven function. The controller 100 switches on a self-cleaning switch 104 to perform a self-cleaning function after food is cooked. Depending on switching of the self-cleaning switch 104, the controller 100 operates a solenoid device 32, so a rod 32*a* installed in the solenoid device 32 descends and a link 30 coupled to the rod 32*a* descends together.

Then, as the link 30 descends, engaging member 28 coupled to the link 30 descends and a fitting part 28*a* of the engaged fragment 28 is fitted to a locking pin 26. By this, when a user undesirably intends to open a door (D) by force, a rear surface of the fitting part 28*a* is caught by a front surface of the fitting protrusion 26*a* of the locking pin 26, thus avoiding inadvertently opening the door (D).

Then, when the self-cleaning function of the oven is completed and a temperature decreases below a predetermined temperature (desirably, a room temperature of 30 ° C. to 50 ° C. with no danger of burn), a temperature sensor 106 senses and transmits the temperature signal to the controller 100 and the controller 100 sends an electrical signal to the solenoid device 32 to disable a locking function. At this time, a locking means 50 initiates an unlocking operation inverse to a locking operation. As the rod 32*a* ascends, the link 30 coupled to the rod 32*a* also ascends. As a consequence, the engaging member 28 coupled to the link 30 ascends, so the coupling between the locking pin 26 and the engaging member 28 is released. After that, a user can open the door (D) with a handle (not shown) of the door (D).

According to an alternative embodiment , in order for the user to manually open the door upon occurrence of power failure or emergency after completion of the self-cleaning function, a separate hole or open/closable small door can be provided at a place where the locking means 50 is installed, desirably, in the receptacle (R) such that the user can move up the engaging member 28 manually.

As described above, exemplary embodiments of the present invention provide an effect of preventing a careless infant or user from getting burned because of an internal heat when artificially opening a door, by installing a solenoid device in a receptacle of an oven to forcibly lock the door at the time of execution of a self-cleaning function of the oven.

Further, there is an effect of providing a good appearance by installing a locking device within the receptacle.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A door lock device for locking a door of a heating appliance comprising:

a fixing rack having a first end affixed to a receptacle of a heating appliance and a second end coupled with a hinge shaft;

an operation rack affixed to a door of the heating appliance, the operation rack coupled with the hinge shaft of the fixing rack to open and close the door about the hinge shaft;

a solenoid device installed in the receptacle and having a rod;

an engaging member coupled to the rod of the solenoid device and ascending or descending in response to an operation of the solenoid device, the engaging member having a fitting part at a distal end thereof, the fitting part having an open-ended, U-shaped groove at a distal end thereof; and a locking pin affixed to the operation rack, the locking pin having a generally cylindrical or bar shape with an enlarged fitting protrusion formed at a distal end of the locking pin such that the fitting protrusion can be caught by the U-shaped groove of the fitting part of the engaging member to lock the door when the engaging member is descended by operation of the solenoid device and that the fitting protrusion can be released from the U-shaped groove of the fitting part of the engaging member to unlock the door when the engaging member is ascended by operation of the solenoid device.

2. The device of claim 1, further comprising a sensor for sensing the temperature of the receptacle, and a controller for controlling the operation of the heating appliance, wherein the controller is configured to operate the solenoid device to lock the door when the temperature of the receptacle is above a predetermined temperature and to unlock the door when the temperature of the receptacle is below the predetermined temperature.

3. The device of claim 1, wherein the operation rack includes a fitting hole, and a proximal end of the locking pin is fixed in the fitting hole of the operation rack.

4. The device of claim 3, further comprising a connection member fixed to the operation rack, the connection member including a fitting hole corresponding to the fitting hole of the operation rack, and wherein the proximal end of the locking pin is fixed in the fitting holes of the operation rack and the connection member.

5. The device of claim 1, further comprising a rotary plate rotatably coupled to the fixing rack, and a spring having one end coupled to the operation rack and the other end coupled to a distal end of the rotary plate.

6. The device of claim 5, wherein the rotary plate having a guide pin at the distal end, and the operation rack includes a cam guide hole configured to receive the guide pin of the rotary plate such that the guide pin moves slidably in the cam guide hole to provide tension to the spring for smooth opening of the door.

7. The device of claim 6, wherein the operation rack has a U-shaped cross section, and the cam guide hole is disposed at both lateral sides of the U-shaped operation rack.

* * * * *